United States Patent [19]

Lucas et al.

[11] 4,414,002

[45] Nov. 8, 1983

[54] METHOD FOR GASIFICATION OF LARGE-SIZED VEGETABLE MATERIALS USING A FIXED BED GASOGENE

[75] Inventors: Jean Lucas, Paris; Jean-Francois Molle, Choisy le Roy; Etienne Gille, Longjumeau; Patrick Creze, Bois Guillaume, all of France

[73] Assignee: Centre National d'Etudes et d'Experimentation de Machinisme Agricole, Antony, France

[21] Appl. No.: 272,369

[22] Filed: Jun. 10, 1981

Related U.S. Application Data

[62] Division of Ser. No. 90,911, Nov. 5, 1979, abandoned.

[30] Foreign Application Priority Data

Nov. 6, 1978 [FR] France ..... 78 31356

[51] Int. Cl.[3] ..... C10J 3/14

[52] U.S. Cl. ..... 48/209; 48/203

[58] Field of Search ..... 48/209, 197 R, 210, 48/202, 203, 206; 201/27, 28, 25, 21, 2.5, 32, 37

[56] References Cited

U.S. PATENT DOCUMENTS

| | | | |
|---|---|---|---|
| 1,639,391 | 8/1927 | Wallace | 201/37 |
| 1,814,463 | 7/1931 | Trent | 48/202 |
| 1,964,877 | 7/1934 | Hereng | 48/73 |
| 3,990,865 | 11/1976 | Cybriwsky et al. | 48/197 R |

*Primary Examiner*—Peter F. Kratz
*Attorney, Agent, or Firm*—Staas & Halsey

[57] ABSTRACT

A method for the gasification of large-sized vegetable materials using a fixed bed gasogene. This gasification method includes the steps of moving the materials in a fixed treatment chamber extending substantially horizontally and having opposite rear and forward ends, the materials being moved from the rear end towards the forward end through substantially the whole transverse section of the chamber and being successfully subjected to drying, pyrolysis and gasification in successive areas of the chamber. Hot gases are generated by combustion in a zone free of materials to be treated and located in the chamber in front of the natural talus created by the front of the whole bulk of materials which occupy substantially the whole transverse section of the chamber. Gases are extracted from the chamber and recycled into the zone in front of the natural talus, whereby tar produced from the pyrolysis and carried away by the extracted gases is eliminated by heating the recycled gases in the zone. The temperature of the extracted gases is at least 500° C. after having passed through the materials contained in the chamber. The gas having passed through the material in the gasification area is taken out from the chamber at a location in front of the pyrolysis area product, whereby the product gas is freed from tars.

3 Claims, 4 Drawing Figures

METHOD FOR GASIFICATION OF LARGE-SIZED VEGETABLE MATERIALS USING A FIXED BED GASOGENE

This is a division, of application Ser. No. 090,911 filed Nov. 5, 1979 now abandoned.

The present invention relates to a fixed bed gasogene for the treatment of large-sized vegetable materials.

In a fixed bed gasogene, the contact between the vegetable materials being treated and the hot treatment gases is produced by flowing the said gases through a bed of materials. These should be in the form of particles heavy enough not to be carried away with the hot gases. The field of application of the gasogene according to the invention is therefore limited to large-sized vegetable materials. Nonlimitative examples of what is meant here by these terms are logs, nut and coconut shells, palm shells, coconut flocks, maize cobs, peat, etc. Other finer vegetable materials, such as straw for example, may also be used if compressed beforehand.

Fixed bed gasogenes have been known for a long time, such as for example the De Lacotte gasogenes. These consist of a tower fed from the top with materials to be treated, and at the base of which the resulting ashes and gases are recovered, the materials being subjected successively to a drying, a pyrolysis and a gasification step.

Gases are recovered from the top end of the gasogene and mixed with combustion air, and the very hot gases that result are re-injected into the gasogene substantially on the limit between the pyrolysis area and the gasification area. Part of the re-injected gases ascend into the gasogene, ensuring the pyrolysis and the drying and taking up the tar produced by the pyrolysis, said tar being removed by cracking after mixing with combustion air. The other part of the gases descend into the gasogene, ensuring the gasification.

These known gasogenes have various disadvantages.

The first one is that the treatment is very slow and this leads to large-sized gasogenes. For example, wood-burning gasogenes of the De Lacotte type have been produced which can reach 20 meters in height for a diameter of 3 m and a flow rate of 1 T/hr, and where 24 hours can elapse between the introduction of a log at the top of the gasogene and the recovery of its ashes at the base thereof. The overall size of such gasogenes and their production costs are prohibitive and make them difficult to exploit.

A second disadvantage resides in the fact that it is extremely difficult to inject the hot gases uniformly over the whole cross-section of the products contained in the gasogene, at the level where said injection takes place. Even though several injection orifices are provided all around the gasogene, there is a considerable cooling down of the gases before these come into contact with the product in the centre. In order to overcome this, it is known to narrow down the cross-section of the gasogene where the hot gases are injected in order to realize the injection as near as possible of the axis of the gasogene. It happens however that such a narrowing down interferes with the flow of treated materials especially because of the agglomeration of products and the formation of bridges due to the presence of tar substances during the pyrolysis.

A further disadvantage of fixed bed vertical gasogenes of the De Lacotte type is that they give very few possibilities of controlling the flow of gases produced.

Indeed, such a control can only be done by changing the quantity of combustion air used to produce the hot gases, hence a limited control capacity. In addition, the responding time of the gasogene is very long, that-is-to-say that a long interval elapses between the moment when the control takes place and the moment when its effects are felt.

The U.K. Pat. No. 353 271 discloses a gasogene comprising a vertical feeding and pyrolysis chamber and an horizontal gasification chamber having a lower wall constituted by a conveyor. Recycled gases are mixed with combustion air beneath the horizontal chamber and the combustion gases are injected through the conveyor under the materials to be gasified. The recycling of the gases is performed as in gasogenes of de Lacotte type and similar performances are to be expected. In addition the gasogene disclosed in the U.K. Pat. No. 352 271 cannot be used for gasifying material having ashes with a low melting temperature, such as vegetable materials, otherwise the passages for the hot gases through the conveyor would rapidly be obturated.

It is the object of the present invention to propose a gasogene of the fixed bed type with none of the aforesaid disadvantages. More specifically, the object of the invention is to propose a gasogene suitable for gasifying vegetable materials, and having in particular the following properties:

for the same output, a substantial reduction of the treatment duration, the overall size as well as of installation and marketing costs, compared with the already known fixed bed gasogenes mentioned hereinabove, a uniform treatment of the gasogene contents by the hot gases, over the whole cross-section thereof of said gasogenes, a total gasification with production of tar-free gases, greater control possibilities than with the known gasogenes and with shorter response time.

This object is reached with a gasogene comprising a treatment chamber extending horizontally; means for feeding the materials to be treated to said chamber, said feeding means being located at a rear end of the treatment chamber; means for causing the materials in said chamber to move forward between said rear end and a forward end of said chamber; an opening provided in the lower part of said chamber at the forward end thereof; a first and a second gas exits located apart from each other in the wall of the treatment chamber, said first exit being located near said rear and said second exit constituting the gas outlet of the gasogene; gas recycling conduit means connected to said first exit; sucking means arranged in said conduit means for setting up a forced stream of gas through the materials to be treated from said forward end to said first exit and thereby recycling gases having a temperature preferably above 500° C.; and hot gases generating means connected to comburent gas feeding means and to said gas recycling conduit for producing hot combustion gases in a zone inside said treatment chamber and in front of the natural talus created by the front of the materials in said chamber, whereby the materials to be treated are subjected to said hot combustion gases over the whole transverse section of the treatment chamber.

The recycling with suction creates a forced flow of hot gases rearwardly through the gasogene, so that the materials admitted for treatment into the treatment chamber are brought in direct contact with gases of a relatively high temperature. The drying and pyrolysis are thus effected very quickly. The recycled gases are fed in the zone of the treatment chamber free of materials to be treated in front of the natural talus formed by these materials, and the combustion of the recycled gases takes place in this zone. The terms natural talus designate the form that the front end of the bulk of materials contained in the treatment chamber takes by gravity only. This natural talus needs not a supporting member such as a grid or a wall which hardly sustains the thermal conditions required for the gasification and makes it therefore necessary to limit the working temperature. The front end of the materials contained in the treatment chamber is directly subjected to the action of the hot combustion gases. This makes it possible together with the forced flow of the gases, to obtain fast and complete chemical reactions. The hot combustion gases are used in the best possible conditions in order to perform a rapid gasification. This high treatment speed leads to a gasogene having reduced size and manufacturing cost.

The horizontal disposition of the treatment chamber makes it possible to solve the problem of the uniform injection of hot gases through the whole transverse section of the materials contained in the gasogene because the injection is performed over the whole surface of the natural talus. It will be noted on this point that the admission of hot gases through orifices provided at the lower end of a known vertical gasogene in such a way to perform a uniform injection of hot gases through the whole transverse section would not be possible because the orifices would be subjected to important mechanical forces under severe thermal conditions and would very quickly be blocked by the ashes deposited and coagulated.

Further, a special possibility is offered to alter the flow of the gases produced by controlling the flow of the recycled gases. In addition, due to the fact that the speed of reaction is high and mainly depends upon the recycling the gasogene responds to such a control almost instantly.

The comburent gas used may be air or oxygen. When oxygen is used for performing the gasification, the temperature reached is so high that the ashes of the vegetable materials, including peat, melt in the gasification zone, the melting temperature of these ashes being approximately 800° C. An advantage of the gasogene of the invention is that the combustion gases are not injected directly into the bulk of materials but are injected in a zone free of materials to be treated and are diluted before entering the talus of materials.

According to another special feature of the gasogene according to the invention, the said second exit and the combustion air feed pipe are connected to a heat exchanger so as to heat up the combustion air with the calories carried by the gases produced by the gasogene.

Other characteristics and advantages of the gasogene according to the invention will become apparent on reading the following description of a special embodiment, given by way of example and non-restrictively, reference being made to the accompanying drawings in which.

Figure 1:
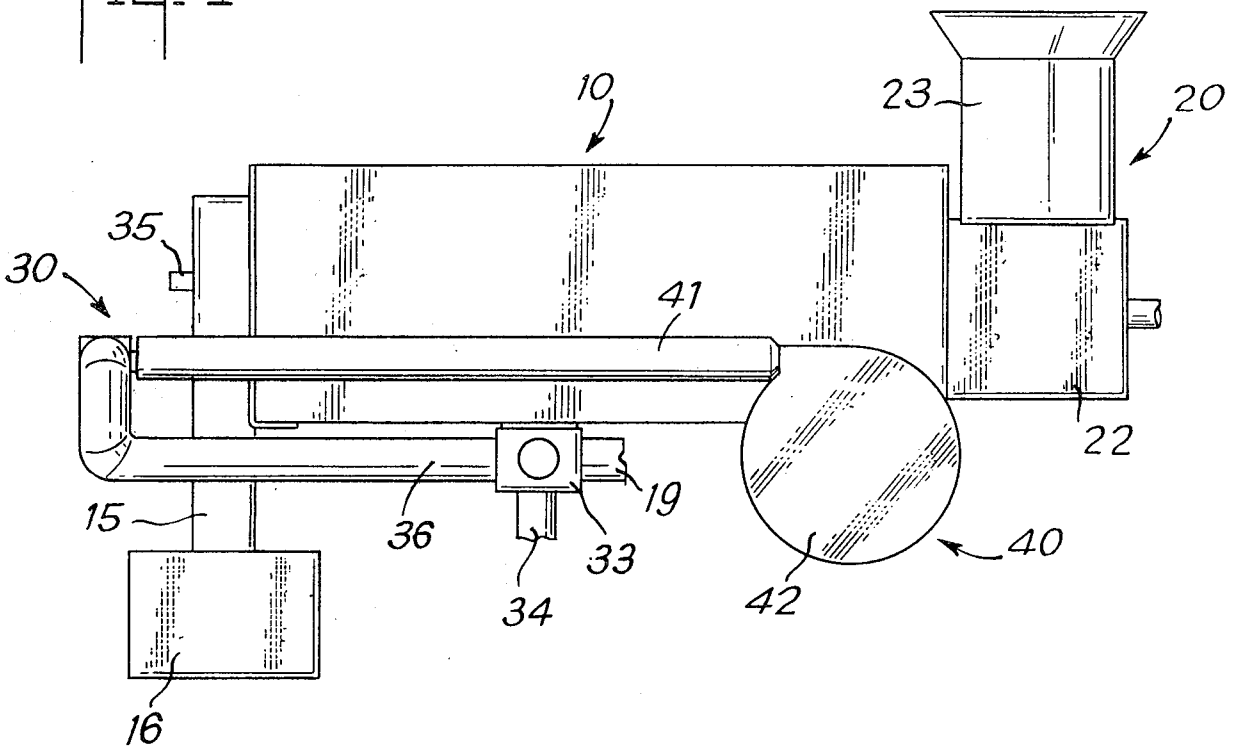
FIG. 1 is a simple diagram of a side elevation of a gasogene according to the invention.
Figure 2:
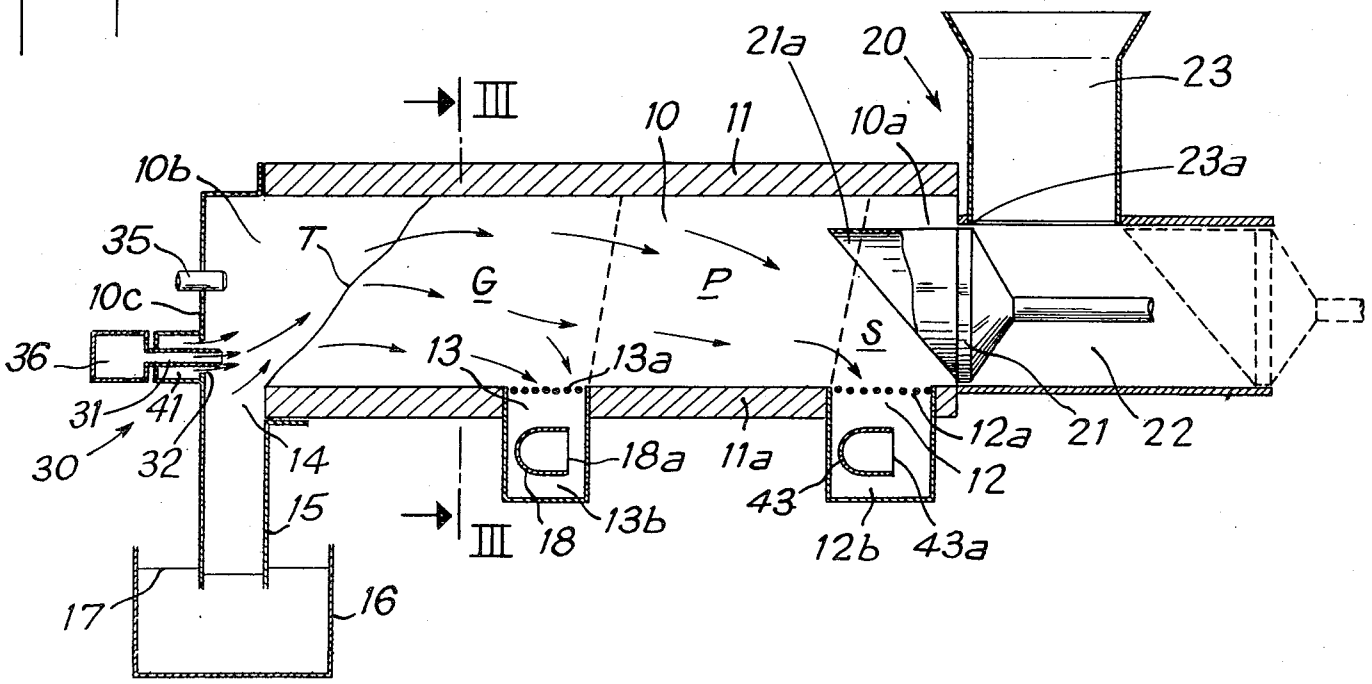
FIG. 2 is another simple diagram of the gasogene shown in FIG. 1, but showing an elevation and median longitudinal cross-section along line II—II of FIG. 4.
Figure 3:
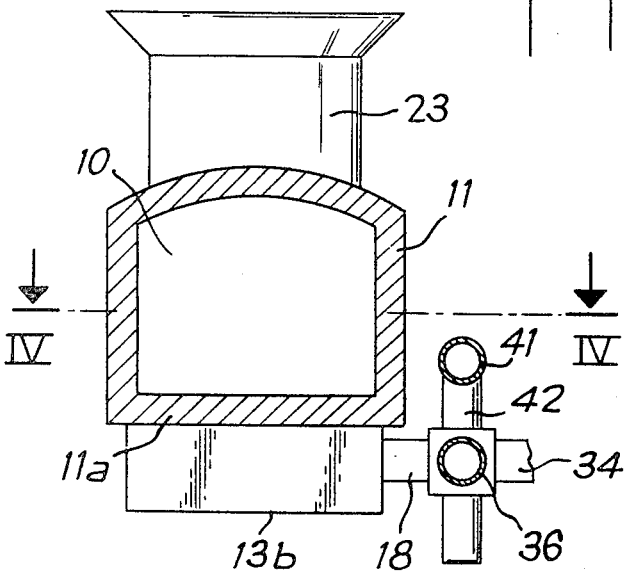
FIG. 3 is across-section along line III—III of FIG. 2.
Figure 4:
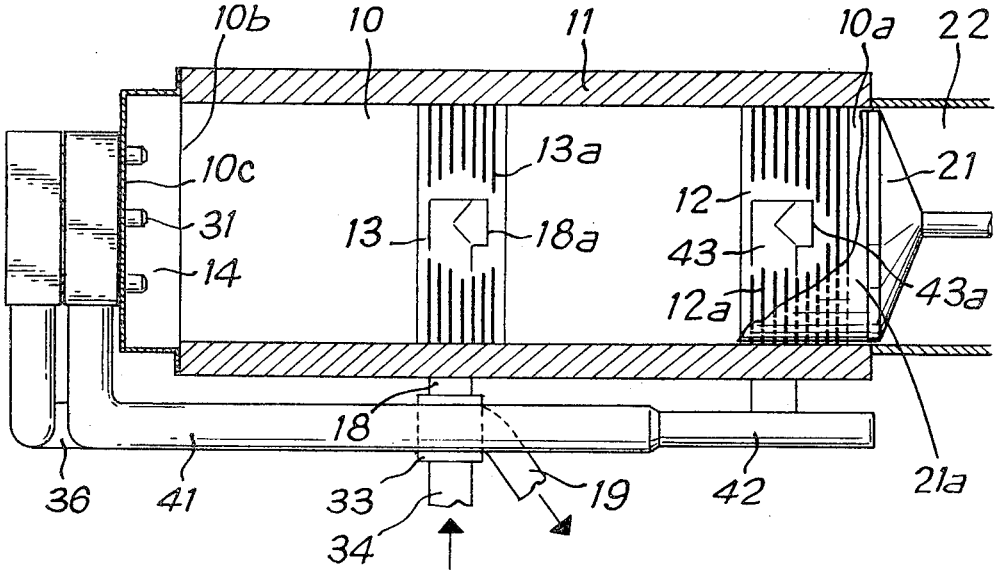
FIG. 4 is a cross-sectional top view along line IV—IV of FIG. 3.

The gasogene illustrated by FIGS. 1 to 4, essentially comprises a horizontal treatment chamber 10, a feeding means to feed the said chamber 10 with materials to be treated through its rear end 10*a*, a means 21 for pushing the materials forward into said chamber 10, a generator 30 supplying hot gases to the front end part 10*b* of said chamber 10, and a recycling device 40.

The shape of the chamber 10 is that of a horizontal tunnel whose side wall 11 is made of a refractory material, and is extended at the back by a supply chamber 22 and closed at the front by a front wall 10*c*. In the floor 11*a* of the chamber 10 are formed, frontwards from the back, a first exit 12 fitted with a grid 12*a*, a second exit 13 fitted with a grid 13*a* and an outlet 14.

The exit 12 is situated at the rear end of the floor 11*a*, or in the immediate vicinity of said rear end.

The exit 13 is an outlet for the gases produced by the gasogene; it is formed in the middle part of the tunnel or slightly on the front side thereof. An outlet pipe 18 is connected with the exit 13 and issues, in 18*a*, towards the rear of the gasogene, into a chamber 13*b* situated under the grid 13*a*.

The opening 14 is formed over the whole width of the floor 11*a* and at the front end of said floor. It communicates, via a vertical channel 15, with a tank 16 situated under said chamber 10 and wherein the ashes from the materials treated in the gasogene are recovered. A water seal diagrammatically shown in 17, is provided to compensate the difference in the pressures prevailing outside and inside the gasogene when said latter is in operation.

The supply chamber 22 is surmounted by a lock chamber for admitting the materials to be treated. A piston 21 can slide horizontally in the chamber 22 over the entire length thereof. The piston 21 is provided with a cap 21*a* fixed on the front face of the piston and overhanging this face.

When the said piston is in its far back position (shown in broken line in FIG. 2), the contents of the lock chamber 23 is admitted into the chamber 22. The forward movement of said piston is thereafter controlled at a slow and constant speed which is equal to the speed at which the materials are thermally treated in the chamber 10.

The materials having just been introduced into the chamber 22 tend to rise when subjected to the pushing action of the piston. However, this rising movement is limited by the cap 21*a*. No piece of material is then squeezed between the front face of the piston and the lower forward edge 23*a* of the chamber 23, and the risk of a blocking of the piston advance is eliminated.

When the piston is in its foremost position (shown in unbroken line in FIG. 2), it is instantly returned to the back position to admit another load of materials into the chamber 22.

Into the front of the chamber 10 there issues at least one comburent gas injector 31, for example one combustion air injector. Preferably, a plurality of injectors 31 are provided, forming a horizontal row at a level which is immediately above the level of the floor 11*a*. Said or each injector 31 is supplied with air from a pipe 36 connected to a heat exchanger 33. Said latter receives the pipe 18 and a pipe 34 supplying cold air. Said cold air is heated up in the exchanger 33 with the calories carried by the gases produced by the gasogene, which gases, when cooled, escape via a pipe 19.

At the level of each injector 31, there issues a nozzles 32 which is supplied with gas by a recycling pipe 41 connected to the exit 12. Each assembly 31–32 is arranged in order to ensure the mixture of air and combustible recycled gases as in a known gas burner.

A suction device 42 constituted by a refractory blower able to stand high temperatures is placed between a pipe 43 connected with the exit 12 and the pipe 41. The said pipe 43 opens, in 43*a*, towards the rear of the gasogene, into a chamber 12*b* situated beneath the grid 12*a*.

At least one burner 35, adapted to be supplied with fuel is placed at the back of the chamber 10.

The gasogene described hereinabove works as follows:

The treatment chamber 10, having been filled with materials to be gasified, the burner or burners 35 are set into operation, as well as the suction means 42.

Once the chamber 22 has been filled and the piston 21 is in the back position, the control of the forward movement of the latter starts immediately the operations of drying, pyrolysis and gasification have begun.

The starting phase in the operation of the gasogene being completed, a fact which can be checked by watching the flow of the gases produced, the burner 35 is cut off. The hot gases are then produced by the reaction of the gases recycled in the pipe 41 with the combustion air admitted at the front of the chamber 10.

The hot combustion gases are produced at the forward end of the chamber 10 in a zone 10*b* free of materials to be treated and in front of the natural talus T formed at the front end of the materials contained in the chamber 10. The particles of materials closest to the opening 14 are attacked by the hottest gases (about 1200° C.), any carbon left in the centre of the said particles is thus reached and the rejected ashes have been entirely gasified.

The hot gases move from the front towards the back flowing through the materials to be treated under the suction effect of the blower 42. The location of the exits 12, 13 in the floor of the chamber 10 forces the combustion gases to flow through the whole bulk of materials contained in the chamber.

In the gasification area G, the temperature of the gases reduces progressively and reaches about 800° C. at the level of the exit 13. Any gases not picked up by that exit, go through, towards the back, the areas of pyrolysis P and of drying S before being caught back into the recycling pipe via the exit 12. The temperature of the recycled gases is at least 500° C., and between about 600° and 700° C.

In the drying and pyrolysis areas, the temperature of the gases is relatively high. The time needed for both these operations is therefore short. As a result, these drying and pyrolysis areas are short-lengthed.

When flowing through the pyrolysis area, the gases pick up all the tar produced from the pyrolysis. Said tar is carried away by the recycled gases. Since the latter are admitted into the chamber 10 through the flames produced by the combustion the recycled gases necessarily traverse an area where the temperature is such that the tar carried by the recycled gases are removed therefrom by cracking or combustion.

As indicated hereinabove, the exit 13 is where the gas produced by the gasogene is taken from. In order to avoid the presence of tar in said gas, it is preferably for the exit 13 to be situated in front of the pyrolysis area or at the most between said area and the gasification area.

In practice, this means that the exit 13 is situated at a distance of the opening 14, at the front of the chamber 10, varying between L/4 and L/2, L being the distance between the rear end of the chamber 10 and the opening 14.

The exits 12 and 13 are situated in the floor 11*a* of the chamber 10. The hot gases flowing through the materials contained in the chamber thus necessarily come into contact with any materials situated at the bottom of the chamber 10, which might not be the case if the openings 12 and 13 were to be situated at a certain height above the floor 11*a*. However, it is possiible to envisage, especially for the exit 12, the provision of several openings made in the floor and in the sides of the chamber 10 and to connect them to the recycling pipe.

The forward movement of the materials inside the chamber 10 is ensured by the piston 21. It will be noted that the materials admitted into the chamber are immediately brought to a high temperature (several hundreds °C.). The carbonizing of the materials is very rapid. The materials to be treated thus become rapidly friable, and in particular in the region of the wall 11, which prevents these materials from getting jammed up and from resisting the force exerted by the piston 21. The forward movement of the said piston is interrputed when the latter reaches the front of the chamber 22, said interruption lasting only long enough to return the said piston to its back position and to fill the chamber 22. The forward movement of said piston can then be resumed immediately.

The forward movement of the piston 21 is determined as a function of the speed of treatment inside the chamber.

Said speed of treatment is relatively high in the present case, because the materials are subjected to high temperatures immediately upon their admission into the chamber 10.

The speed of treatment is not only dependent upon the temperature of the gases flowing through the bed of materials to be treated, but also and mainly upon the flow of the recycled gases and as a consequence upon the flow of gases traversing the chamber 10. Thus, a strong recycling means a strong flow of gas in the gasification area and, as a result, a high speed of reaction.

In addition to the control of the quantity of combustion air injected, there is therefore a possibility to control the flow of recycled gases inorder to adjust the speed of treatment and the quantity of gases produced to the desired values.

The flow of recycled gases may be controlled by adjusting the position of an adjustable flap inserted in the pipe 43 or by altering the speed of the suction blower 42.

The speed of treatment being quite high and depending essentially upon the recycling, the response time of the gasogene to a modification of the flow of recycled gases is relatively short.

Various modifications or additions may of course be made to the embodiment described hereinabove of a gasogene according to the invention without for all that departing from the scope of protection defined by the accompanying claims.

A fact to be noted in particular is that it is possible to increase the speed of the piston in order to bring it to a value such that no gasification can take place, for producing charcoal.

What is claimed is:

1. A method for the gasification of relatively large-sized vegetable materials, said method comprising the steps of:

moving said materials in a fixed treatment chamber extending substantially horizontally and having opposite rear and forward ends, said materials being moved from said rear end towards said forward end through substantially the whole transverse section of said chamber and being subjected successively to drying, pyrolysis and gasification in successive areas of said chamber;

generating hot gases in a zone free of materials to be treated and located in said chamber in front of the natural talus created by the front of the whole bulk of materials which occupy substantially the whole transverse section of said chamber;

extracting gases from said chamber by aspiration at a location adjacent to the rear end thereof whereby a forced stream of hot gases is produced rearwardly through the whole bulk of materials contained in said chamber and over the whole transverse section thereof;

recycling said extracted gases into said zone in front of said natural talus and adding a comburent gas to said recycled gas whereby heat for generating said hot gases is produced by combustion, said hot gases being diluted in said zone before entering said natural talus, and said tars produced from the pyrolysis and carried away by said extracted gases being eliminated by said combustion in said zone;

adjusting said aspiration so that the temperature of said extracted gases is at least 500° C. after having passed through the materials contained in said chamber; and taking out from said chamber and at a location in front of said pyrolysis area product, gas having passed through said material in said gasification area, whereby said product gas is free from tars.

2. A method as claimed in claim 1, wherein said aspiration is adjusted so that the temperature of the extracted gases is between 600° and 700° C.

3. A method as claimed in claim 1, wherein said recycled gases are extracted near the rear end of said chamber at least through an opening located below the materials in said chamber.

* * * * *